United States Patent [19]

Schreder et al.

[11] Patent Number: 4,538,051

[45] Date of Patent: Aug. 27, 1985

[54] HEATING ELEMENT FOR HEATING BOILING PLATES, HOTPLATES AND THE LIKE

[75] Inventors: Felix Schreder; Leonhard Dörner, both of Oberderdingen; Eugen Wilde, Knittlingen, all of Fed. Rep. of Germany

[73] Assignee: E.G.O. Elektro-Gerate Blanc U. Fischer, Fed. Rep. of Germany

[21] Appl. No.: 602,122

[22] Filed: Apr. 19, 1984

[30] Foreign Application Priority Data

Apr. 28, 1983 [DE] Fed. Rep. of Germany ..... 3315438

[51] Int. Cl.[3] ..... H05B 3/68

[52] U.S. Cl. ..... 219/466; 219/449; 219/446; 219/463; 219/464; 338/299

[58] Field of Search ..... 219/445, 446, 447, 448, 219/449, 450, 451, 452, 453, 459, 463, 464, 466, 467, 532, 536, 537, 552, 539; 338/282, 287, 288, 289, 293, 295, 297, 299

[56] References Cited

U.S. PATENT DOCUMENTS

| | | | |
|---|---|---|---|
| 1,177,254 | 3/1916 | Lawrence | 219/463 |
| 1,527,232 | 2/1925 | Smith | 219/463 X |
| 1,831,110 | 11/1931 | Heise | 219/463 |
| 2,145,564 | 1/1939 | Wiegand et al. | 219/463 |
| 2,235,091 | 3/1941 | Vineberg | 338/297 |
| 2,417,223 | 3/1947 | Visitation | 219/446 |
| 2,419,083 | 4/1947 | Myers | 219/446 |
| 2,727,133 | 12/1955 | Scofield | 219/463 |
| 2,765,392 | 10/1956 | Park | 219/463 X |
| 4,243,874 | 6/1981 | Fischer | 219/467 |
| 4,313,052 | 1/1982 | Fischer | 219/446 |
| 4,347,432 | 8/1982 | Gössler | 219/449 |

FOREIGN PATENT DOCUMENTS

| | | |
|---|---|---|
| 1239034 | 4/1967 | Fed. Rep. of Germany . |
| 2459649 | 1/1976 | Fed. Rep. of Germany . |
| 2729929 | 1/1979 | Fed. Rep. of Germany . |
| 7736873 | 5/1979 | Fed. Rep. of Germany . |
| 3129239 | 2/1983 | Fed. Rep. of Germany . |

*Primary Examiner*—Volodymyr Y. Mayewsky
*Attorney, Agent, or Firm*—Steele, Gould & Fried

[57] ABSTRACT

A radiant heating element for heating a glass ceramic plate carries on a circular insulating support heating elements in the form of wire coils fixed thereto, which are arranged in the form of two parallel spiral paths. Two separately switchable heating conductors are successively arranged in one spiral path, while the third heating conductor is positioned alone in the other spiral path. The heating conductors have different power levels and can be switched to different power stages by a seven-timing switch.

11 Claims, 4 Drawing Figures

Fig.1
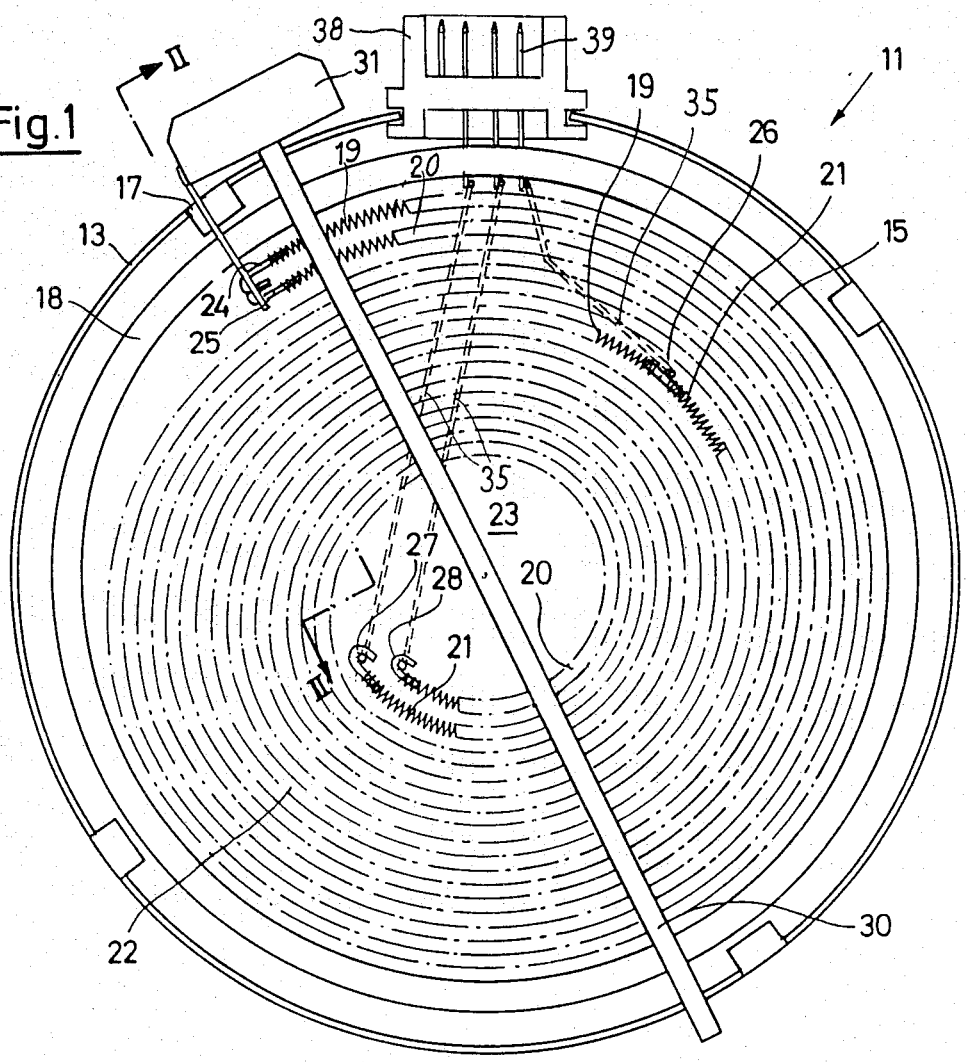
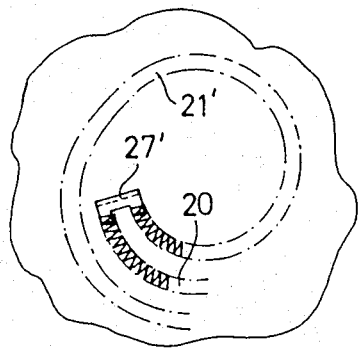
Fig. 3

HEATING ELEMENT FOR HEATING BOILING PLATES, HOTPLATES AND THE LIKE

BACKGROUND OF THE INVENTION

The invention relates to a heating element for heating boiling plates, hotplates and the like with heating conductors arranged in spiral manner. Such heating elements can be formed from an insulating support and a reception shell and, e.g. when heating glass ceramic cooking trays, they are arranged below the glass ceramic plate. Such heating elements are, for example, described in German Pat. No. 2,729,929. The heating conductors are then arranged in the form of wire coils on a disk or card made from insulating material and are located in a reception shell, whilst being surrounded at the bottom and sides by insulating material. There, a heating conductor is provided, which supplies a timing, continuously adjustable power control device with power pulses of different relative ontimes. The mechanical construction of these heating elements has proved very satisfactory. However, it is necessary to use a power control device, which involves a certain manufacturing expenditure and the timing operation is often prejudiced by a heating system with such a low thermal capacity. The heating conductors are spirally arranged on the insulating support and can, e.g. in accordance with Offenlegungsschrift No. 3,129,239, be laid in the form of a double spiral, in which parallel, juxtaposed branches of the same heating conductor are laid as a spiral, the conductor being given a return bend at its centre. The distribution of the heating conductor over the surface is relatively uniform. However, there is the disadvantage that initially the full mains voltage is applied to the parallel branches, so that short-circuiting occurs in the case of a spiral deformation or a foreign body reaching this point.

It is also known to arrange two different heating conductors concentrically to one another in such a way that they can be individually switched, a central area being surrounded by a larger annular area, in order to be able to increase and decrease the effective size of the hotplate.

In the case of hotplates with heating conductors embedded in their bottom surface, it is conventional practice to use a circuit having switch means defining seven selectable conditions, where three separately switchable heating conductors are placed in three parallel spiral paths or pitches, i.e. in the form of a three-path spiral and which can be switched parallel, individually and in series by a cam-operated switch. Six different power stages are formed which, together with the "off"-position form the "seven steps of operation". This circuit is extremely reliable, can be easily operated by the housewife and the associated switch is very simple and is manufacturable with great operating reliability.

However, the construction with three parallel spiral paths requires very careful arrangement of the spirals, which normally perform three turns. In addition, the wire thickness and the helix density must be especially adapted for the individual power levels, because the overall length of the wire helix is given by the length of the spiral ducts. Thus, the wires are too thin for many applications, particularly when the wires are mounted other than by the complete embedding of the helix.

SUMMARY OF THE INVENTION

The object of the invention is to provide a heating element of the aforementioned type, which permits an improved ratio between heating conductor length and power, whilst simplifying construction and making arrangement easier.

This object is achieved by the invention defined in the claims.

Thus, unlike the hitherto adopted procedure of having the three heating conductors parallel to one another from start to finish, in this case two of the heating conductors are successively arranged in a spiral path, which is parallel to the third heating conductor. Thus, account is taken of the fact in an ideal manner that normally one of the heating conductors has a larger power level than the two others. Despite what at first appears to be an irregular arrangement of the individual heated heating conductors in the individual switch positions, a very useful heating pattern is obtained, whilst largely eliminating the central hole produced in other radiant heaters by the spiral turn. The insertion of the advantageously thin heating conductors is improved, because two parallel spirals can be inserted more easily than three parallel spiral rings. The connection possibilities are also improved, because in all only four connection points are required, namely e.g. two connections on the outer spiral ends, a common connection on the central spiral end and one tap of the possibly through-heating resistor, which forms the two heating conductors arranged in a spiral path.

The invention can be advantageously used on hotplates with a casting, in which the heating conductors are embedded in an embedding material in slots in the hotplate body. However, use is particularly advantageous in the case of radiant heaters with heating conductors arranged on an insulating support. This makes more particular use of the advantage that all the heating conductors are made from relatively thick and consequently stable wire, which can be readily fixed to the insulating support, e.g. by partial embedding in the insulating support material. Thus, in the case of these radiant heaters, the possibility is given of using a seven-step circuit. This offers the advantageous possibility of only switching off part of the power via a thermal cut-out if overheating occurs. Such a thermal cut-out is particularly important in radiant heaters and must act in a fast and low-inertia manner, because there is otherwise an overheating to the glass ceramic cooking surface, which is consequently permanently damaged. However, as a result of the seven-step circuit, the switching frequency of the cut-out can be considerably reduced, so that radio interference is not to be feared.

Features of the preferred further developments of the invention can be gathered from the subclaims and description, in conjunction with the drawings, whereby the individual features can be realised singly or in random combinations, in connection with an embodiment of the invention.

BRIEF DESCRIPTION OF THE DRAWINGS

The invention is described in greater detail hereinafter relative to non-limitative embodiments and the attached drawings, wherein:

FIG. 1 is a plan view of a heating element according to the invention constructed as a radiant heater.

FIG. 3 is a detail through a central area of a further embodiment.

DETAILED DESCRIPTION OF THE INVENTION

Figure 2:
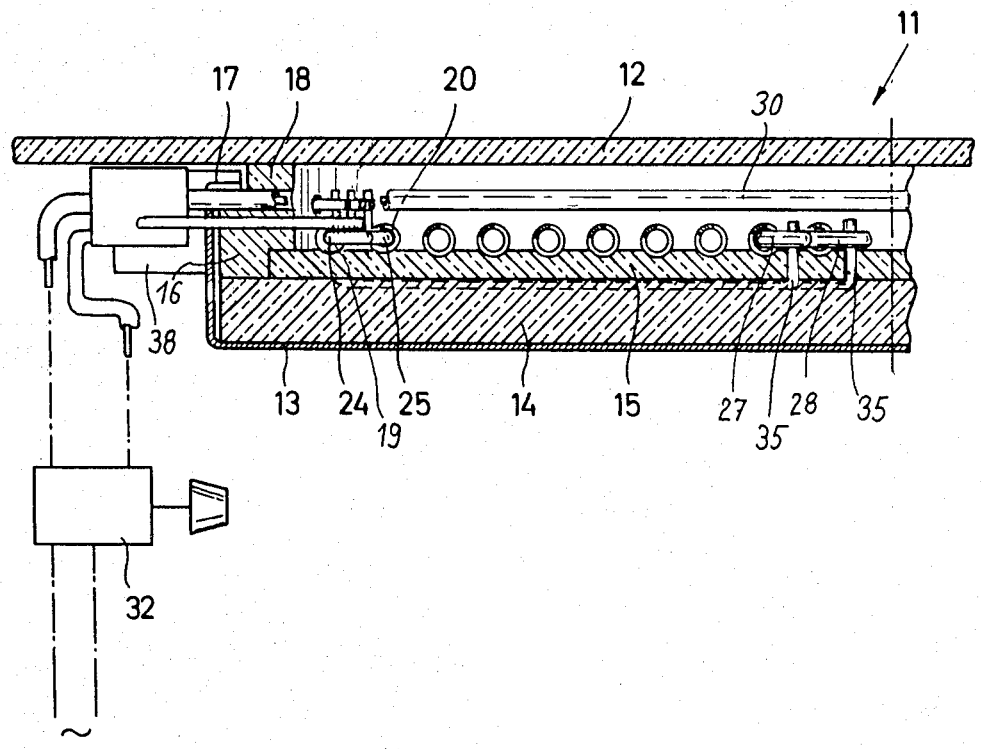
FIG. 2 is a section along line II in FIG. 1.

FIGS. 1 and 2 show a heating element, which is constructed for the radiant heating of a glass ceramic plate 12. The latter forms a continuous cooker plate, under which several radiant heating elements are arranged in order to provide heated cooking areas. The heating element is constructed in a similar way and is placed under the glass ceramic plate in the manner described in German Pat. No. 2,729,929. It has a sheet metal support shell 13 in which is located an insulating layer 14, on which is provided a relatively thin and mechanically stronger insulating support 15, whose edge is held down and centered by an insulating ring 16. Sheet metal tabs 17 on the upper rim of the support shell 13 are bent round a step of insulating ring 16 and hold the unit together. The upwardly projecting rim 18 of the insulating ring engages on the bottom of the glass ceramic plate 12 under the tension of a spring (not shown), which presses the complete heating element from below against the glass ceramic plate.

Heating conductors 19, 20, 21 are arranged on the insulating support by partial pressing into the latter, which is made from a fibrous, high temperature-resistant insulating material and by corresponding compression is made relatively thin and mechanically relatively strong. With the lower part of their helical, the heating conductors are pressed somewhat into the insulating support, so that they are secured by the latter, without significant parts of their radiating surface being covered. The heating conductors are consequently substantially located on the insulating support surface.

The three heating conductors 19, 20, 21 are arranged in the form of a two-part spiral, i.e. two spiral turns are in each case juxtaposed in parallel, the two heating conductors 19, 20 being successively arranged in one spiral path, namely the outer path in the represented embodiment. The heating conductors have a relatively limited spacing from one another and centrally leave an unheated central zone 23, which is small compared with the thickness of the heating zone 22 formed around it and on whose edge the two heating conductors 20, 21 terminate in parallel juxtaposed manner.

The following connections are provided. In the vicinity of the outer circumference, two outer connections 24, 25 for heating conductors 19, 20 are relatively closely juxtaposed. Each of the heating conductors 19, 20 comprises a welded-on pin, which is inserted in the helix and is bent over in a crook. These heating conductors are held together by means of a connecting lead 41 inserted through outer edge 18. A common connection 26, connected to heating conductors 19, 21 is provided in the centre of the latter, which form the outer spiral path and consequently also in the central area of the annular heating zone.

In the represented embodiment, this connection is constructed in the form of two separate connection parts, which are electrically interconnected. In addition, there are two inner connections 27, 28, which are welded in the same way as connection 26 to connecting leads 35, which are constructed from solid wire as U-shaped members and are passed through the insulating support 15 at connections 26, 27 28 and at outer edge 18, where they are welded to lead wires 40 passing through outer edge 18 and which lead to an insulating connecting part 38 with connecting lugs 39. The connecting leads 35 run on the bottom of insulating support 35, where they are embedded in the softer insulating layer 14. Thus, all the connecting welds can be made from above.

The wire helixes can have different thicknesses and optionally also different diameters and pitches. In FIG. 1, the two spiral paths have the same length. One is formed by heating conductors 19, 21 and the other by heating conductor 20. However, as can be gathered from FIG. 3, they can also differ and in this case the heating conductor 21 has an additional turn until it once again terminates alongside heating resistor 20 and is connected and fixed thereto by a common connecting piece 27'. The latter is in the form of a sheet metal angle member with a split side which is passed through the insulating support 15 and onto whose two portions are placed and fixed the heating coils. In FIG. 3, connections 27, 28 are electrically interconnected, whilst connections 24, 25 are individually connected. Heating conductors 19, 21 need not have the same length and can in fact have different lengths, corresponding to the desired power distribution. There is a corresponding displacement of connection 26. However, it is also possible to construct the two heating conductors 19, 21 in the form of a throughheating resistor, which has an electrical tap in place of connection 26.

A temperature sensor 30 of a thermal cut-out device 31 projects diametrically over the substantially circular heating element 11 and its switch knob is positioned outside the support shell 13.

Figure 4:
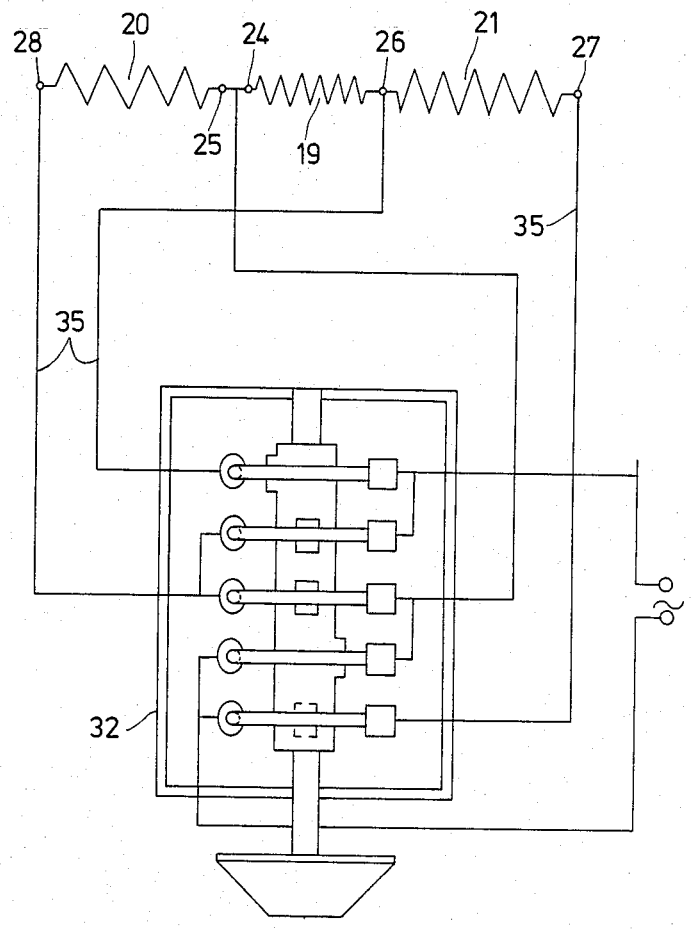
FIG. 4 is a schematic illustration of a circuit according to the invention.

The three separately switchable heating conductors 19, 20, 21 are connected to a seven-step switch 32 (i.e., a multi-pole, seven-throw switch), which is in turn connected to the domestic mains. A suitable circuit for making connections of conductors 12, 20, 21 to the domestic mains using seven-step switch 32 is illustrated in FIG. 4. This seven-position switch switches the three heating conductors in conventional manner in the following power stages:

- Switching position 0: no heating conductor switched on
- Switching position 1: heating conductors 19, 20, 21 in series
- Switching position 2: heating conductors 19 and 21 in series
- Switching position 3: heating conductor 21 alone.
- Switching position 4: heating conductor 19 alone.
- Switching position 5: heating conductors 19 and 21 in parallel
- Switching position 6: all three heating conductors 19, 20, 21 switched in parallel.

The different heating conductors can have different power levels, e.g heating conductor 19 500 W, heating conductor 20 600 W and heating conductor 21 300 W. The power levels, in the same way as the heating conductor lengths can be adapted to requirements, as can the aforementioned circuit diagram. A further advantage is that there is always an unheated conductor between the heated conductors between power stages 2 and 5, so that on the one hand the short-circuit risk is less and on the other the heating pattern is uniform, which is helped by the relatively small unheated central zone 23.

It must also be recognised that in all there are only four electrical connections, which are located at three different points. Apart from the aforementioned advantages of the seven-position circuit for radiant heaters, namely the simpler and more reliable, satisfactorily stepped power switching and the favourable effect on the switching frequency of the thermal cut-out there is the further advantage that the seven-position switch 32 is not dependent on the voltage or power of the heater, as is usually the case with timing power control devices. The thermal cut-out can be connected into the common lead leading to connection 26, or into the common lead leading to connections 27 and 28 and consequently in the aforementioned example of a 1500 W heating element this connects 900 or 1000 W. However, it is also possible to only disconnect one heating conductor. Thus, in most switching stages or positions, the least power is such that the cut-out hardly needs to respond and has a low timing number even if it does respond. The thermal cut-out can also switch the heating conductors in series for reducing power.

Through the arrangement of three heating conductors in two spiral paths, the automatic insertion of the heating elements is simplified, because two spirals can be laid in parallel in the same way as a single spiral. Through the invention, the wire can also be made thicker and can consequently be pressed more easily into the insulating support for fixing purposes. This also leads to a greater thermal stability of the heating conductors.

The drawings show that each of the two spiral paths has five turns, which leads to a uniform heating. As a function of the absolute size of the heating elements, the latter can advantageously also have four or six turns. The heating conductors can also be inserted in the slots of an insulator in the case of a radiant heater.

What is claimed is:

1. A heating element for heating an electrical hot plate, comprising:

a support of electrically-insulating material;

a plurality of electrical heating conductors carried by said support and defining a heating area;

a plurality of connection lines for connecting the heating conductors to a source of electrical energy;

a switching means adapted to switch connections to said heating conductors and said source, the switching means being operable to make individual, parallel and series connections of said heating conductors to said source, to energize the hot plate in a plurality of power stages;

a first of said heating conductors being arranged in a first spiral path having a plurality of windings, said first heating conductor extending from an outer end at an outer limit of said heating area to an inner end at a central zone of said heating area and connected at both said ends to at least one of said connection lines; and, a second and a third of said heating conductors being serially arranged one after the other in a second spiral path interposed between adjacent windings of said first heating conductor, an outer end of said second heating conductor and an inner end of said third heating conductor being arranged at the outer limit and at the central area, respectively, and being there connected to said connection lines, and, the inner end of the second heating conductor and the outer end of the third heating conductor being connected together and to one of said connecting lines, at a connection point situated in the heating area remote from the central zone.

2. A heating element according to claim 1, further comprising a through-resistor, and wherein one heating conductor connection is a center tap of said through-resistor.

3. A heating element according to claim 1, wherein said switching means include a seven-position switch defining said parallel, individual and series connections.

4. A heating element according to claim 1, wherein the insulating support is a thin card, to which the heating conductors are fixed.

5. A heating element according to claim 1, wherein the heating conductors are wire coils.

6. A heating element according to claim 1, wherein the two spiral paths run parallel to one another over substantially their entire length.

7. A heating element according to claim 1, wherein one of the heating conductors extends past another of the heating conductors over a terminal part of a spiral turn.

8. A heating element according to claim 1, wherein the heating conductors are partly embedded on the surface of an insulating support.

9. A heating element according to claim 1, wherein the parallel spiral paths have four to six turns.

10. A heating element according to claim 1, further comprising a thermal cut-out device connected to said heating conductors, the thermal cut-out being arranged to alter said individual, parallel and series connections such that when the thermal cut-out responds, the thermal cut-out leaves a certain amount of power applied to said heating conductors.

11. A heating element according to claim 1, wherein connecting leads are provided for the heating conductors, the connecting leads being partly run below the insulating support carrying the heating conductors, the connecting leads being introducable from below in connections for the heating conductors in an edge area of the insulating support, and the connecting leads being weldable from above to the connection lines.

* * * * *